US008925926B2

(12) United States Patent
Alway

(10) Patent No.: US 8,925,926 B2
(45) Date of Patent: Jan. 6, 2015

(54) GAME TABLE SYSTEMS AND METHODS

(71) Applicant: Mark Alway, Mount Vernon, WA (US)

(72) Inventor: Mark Alway, Mount Vernon, WA (US)

(73) Assignee: Phipps Custom Solutions LLC, Mount Vernon, WA (US)

( * ) Notice: Subject to any disclaimer, the term of this patent is extended or adjusted under 35 U.S.C. 154(b) by 72 days.

(21) Appl. No.: 13/705,037

(22) Filed: Dec. 4, 2012

(65) Prior Publication Data

US 2014/0151964 A1 Jun. 5, 2014

(51) Int. Cl.

| | |
|---|---|
| ***F41J 5/00*** | (2006.01) |
| ***A63B 63/00*** | (2006.01) |
| ***A63B 63/08*** | (2006.01) |

(52) U.S. Cl.

CPC ..... *A63B 63/08* (2013.01)
USPC ..... 273/371; 273/400

(58) Field of Classification Search

USPC ..... 273/398–402, 371, 302, 317, 342; 473/564, 568

See application file for complete search history.

(56) References Cited

U.S. PATENT DOCUMENTS

| | | | | |
|---|---|---|---|---|
| 4,045,906 | A * | 9/1977 | Goldfarb et al. | 446/179 |
| 6,283,872 | B1 * | 9/2001 | Lichodziejewski et al. | 473/54 |
| 8,176,745 | B1 * | 5/2012 | Korza et al. | 62/258 |
| 8,282,457 | B1 * | 10/2012 | Edwards | 463/7 |
| 2006/0027971 | A1 * | 2/2006 | Radhakrishnan | 273/309 |
| 2011/0204570 | A1 * | 8/2011 | Lombardi | 273/348 |
| 2012/0013073 | A1 * | 1/2012 | Wyland | 273/287 |
| 2013/0134677 | A1 * | 5/2013 | McDonnell | 273/398 |
| 2013/0249410 | A1 * | 9/2013 | Thompson | 315/158 |

FOREIGN PATENT DOCUMENTS

WO WO 2011105983 A1 * 9/2011

OTHER PUBLICATIONS

Website http://www.beerpongcustoms.com/#gallery, "Truly one-of-a-kind custom tables", Jul. 2011, one page.

* cited by examiner

*Primary Examiner* — Mark Graham
(74) *Attorney, Agent, or Firm* — Michael R. Schacht; Schacht Law Office, Inc.

(57) ABSTRACT

A game table system adapted used with a plurality of cups and at least one ball, comprising a table structure defining a game surface and a plurality of cup areas, a sensor associated with each of the cup areas; and at least one cup light associated with each of the cup areas. The at least cup light is energized to indicate locations of the cup areas. Each sensor is configured to detect when a cup is supported by the game surface on the cup area associated with that sensor.

17 Claims, 11 Drawing Sheets

GAME TABLE SYSTEMS AND METHODS

TECHNICAL FIELD

The present invention relates to game tables and, more specifically, to game tables adapted to facilitate the playing of beer pong.

BACKGROUND

Games such as darts, pool, ping pong, and the like are often played in establishments such as bars, pool halls, and fraternities. Beer pong is a drinking game traditionally played on a surface such as a ping pong table. Cups are arranged in arrays on each end of the table, and ping pong balls are thrown from the one end of the table towards the array on the opposite end of the table in an attempt to bounce the ball into one of the cups. As the balls are bounced into the cups, cups are removed and re-grouped to improve the likelihood that a ball will bounce into one of the cups. Drinking of beverages such as beer may be incorporated into the game.

The need exists for game table systems and methods that improve the experience of playing beer pong and facilitate the staging of beer pong contests and tournaments.

SUMMARY

The present invention may be embodied as a game table system adapted used with a plurality of cups and at least one ball, comprising a table structure defining a game surface and a plurality of cup areas, a sensor associated with each of the cup areas; and at least one cup light associated with each of the cup areas. The at least cup light is energized to indicate locations of the cup areas. Each sensor is configured to detect when a cup is supported by the game surface on the cup area associated with that sensor.

The present invention may also be embodied as a method of playing a game using a plurality of cups and at least one ball comprising the following steps. A game surface is defined. A plurality of cup areas is defined on the game surface. A sensor is associated with each of the cup areas. At least one cup light is associated with each of the cup areas. The at least cup light is energized to indicate locations of the cup areas. Each sensor is configured to detect when a cup is supported by the game surface on the cup area associated with that sensor.

The present invention may also be embodied as a game table system adapted used with a plurality of cups and at least one ball comprising a table structure, a plurality of cup areas, a plurality of sensors, a plurality of cup light arrays, and a control system. The table structure defines a game surface, and the game surface defines first and second set-up areas and a field area.

The plurality of cup areas is defined within each of the set-up areas defined by the game surface. The plurality of sensors is supported by the table structure, and each of the sensors is uniquely associated with one of the cup areas. Each cup light array comprises a plurality of cup lights and is uniquely associated with each of the cup areas. The control system is operatively connected to the sensors and the cup lights. Each sensor is configured to detect when a cup is supported by the game surface on the cup area associated with that sensor. The control system energizes the cup lights such that the cup light arrays indicate a location of at least one of the cup areas.

DETAILED DESCRIPTION

Figure 1:
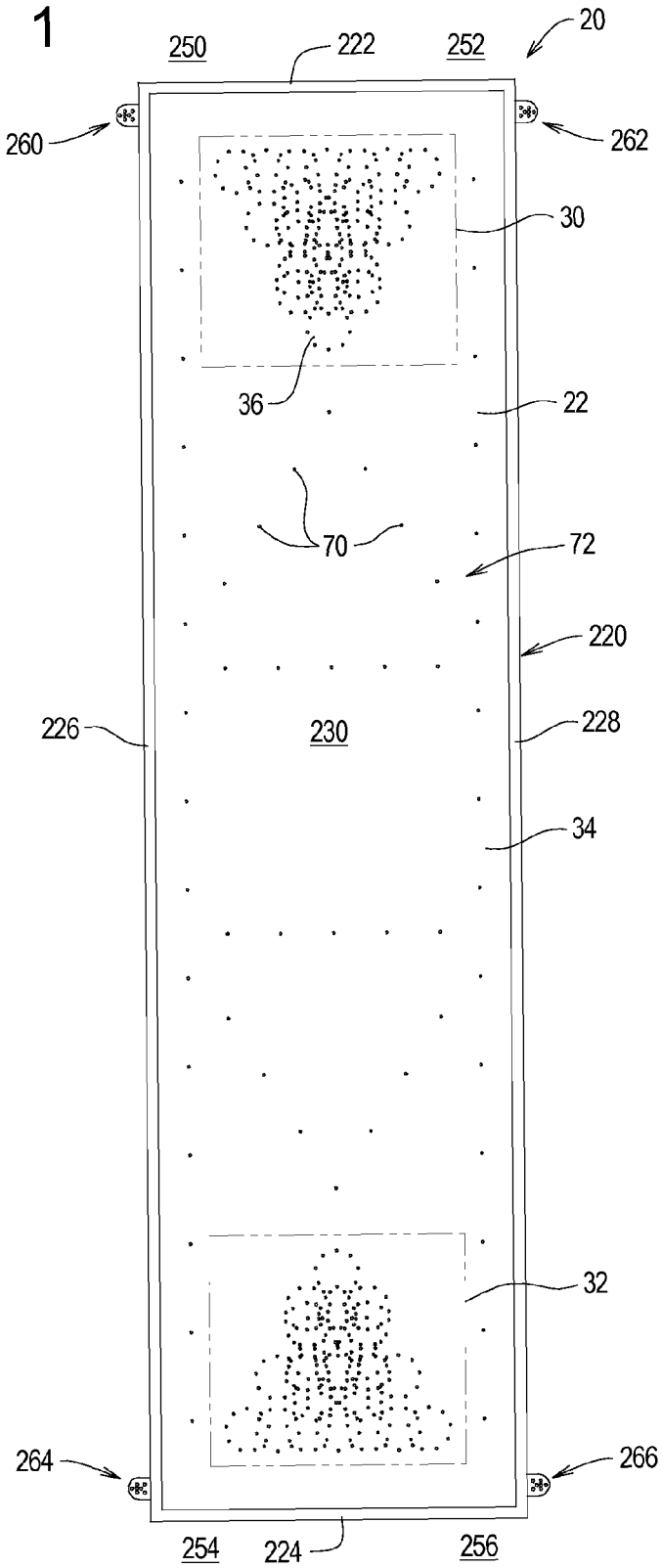
FIG. 1 is a top plan view of an example game table of the present invention.

Referring initially to FIG. 1 of the drawing, depicted therein is an example game table system 20 constructed in accordance with, and embodying, the principles of the present invention. The example game table system 20 defines a game surface 22 adapted to be used with cups 24 (FIG. 2) and one or more balls 26 (FIG. 17) to play beer pong. FIGS. 6 through 10 also show that, to play beer pong, the cups 24 are arranged in any one of a plurality of cup groupings 28 as will be described in further detail below Defined by the game surface 22 are first and second set-up areas 30 and 32 and a field area 34. Any portion of the game surface 22 not forming the set-up areas 30 and 32 as described herein constitutes the field area 34. The example first and second set-up areas 30 and 32 are identical, and only the first example set-up area 30 will be described herein.

Figure 3:
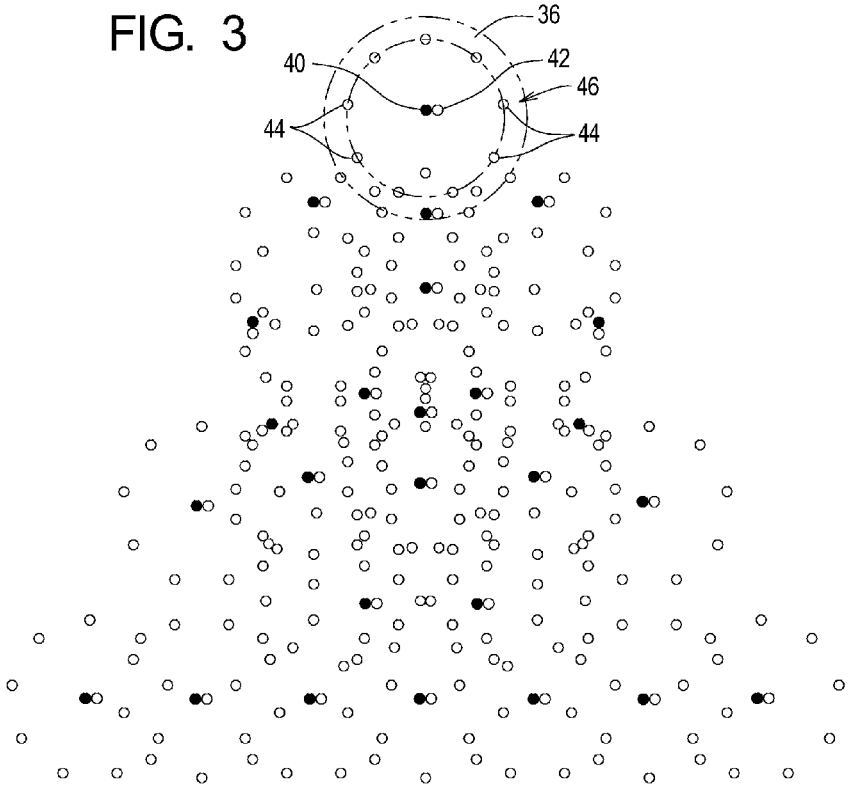
FIG. 3 is a top plan view of an example set-up area defined by the game table of FIG. 1.
Figure 11:
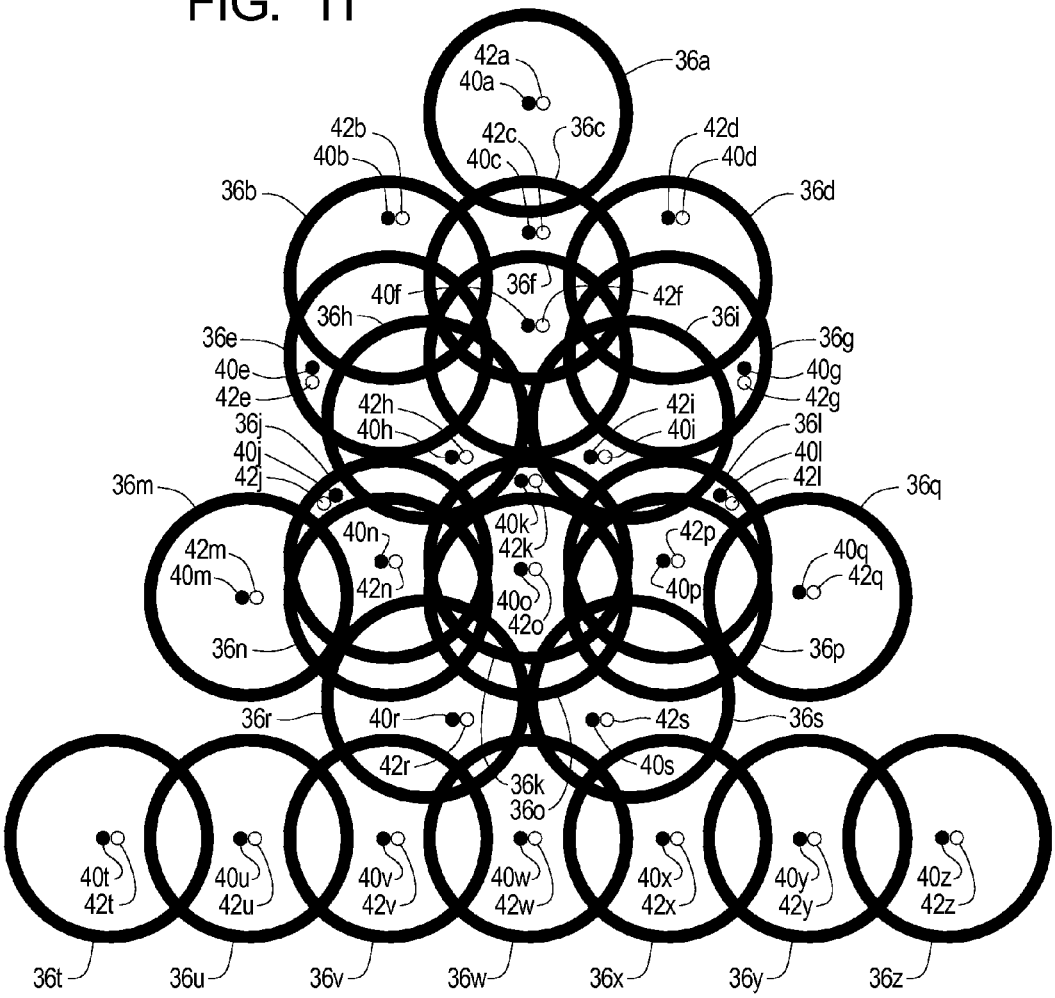
FIG. 11 is a top plan view depicting the association of cup areas and sensors for the example set-up area of FIG. 3.

The first set-up area 30 defines a plurality of cup areas 36. Associated with each of the example cup areas 36 is a ring emitter 40, a ring sensor 42, and a plurality of cup lights 44 (FIG. 3). In the example game table system 20, one ring emitter 40 and one ring sensor 42 are associated with each of the cup areas 36. Additionally, the plurality of cup lights 44 are arranged in cup light arrays 46, and one of the cup light arrays is also associated with each of the cup areas 36. FIG. 11 perhaps best shows that the example first set-up area 30 comprises twenty-six of the cup areas 36*a-z* each comprising one emitter 40*a-z* and one sensor 42*a-z*, respectively.

Accordingly, the cup light arrays 46 define where on the game surface 22 and, in particular, where within the set-up areas 30 and 32 the cups 24 are to be placed for a desired one of the cup groupings 28. FIGS. 6-10 illustrate common cup groupings 28*a-f*, respectively, in which the cups 24 may be placed during the play of beer pong. A close examination of FIG. 11 in comparison to FIGS. 6-10 illustrates that each of the cup groupings 28*a-f* may be formed by one or more of the cup areas 36 within the example set-up areas 30 and 32.

The example game table system 20 comprises a control system capable of controlling the cup lights 44 based on sense signals generated by the sensors 42 in response to an emitted signal emitted by the emitter 40. In particular, the emitters 40 and sensors 42 are arranged within the cup areas 36 to detect the presence of one of the cups 24 within each of the cup areas 36. The sensor 42 associated with a particular cup area 36 generates a sense signal indicative of the presence of a cup 24 within that cup area. The cup lights 44 associated with that particular cup area 36 are activated when the sensor 42 associated with the particular cup area 36 generates a sense signal. The presence or absence of the sense signal may also be used for other purposes as will be described in further detail below.

Figure 12:
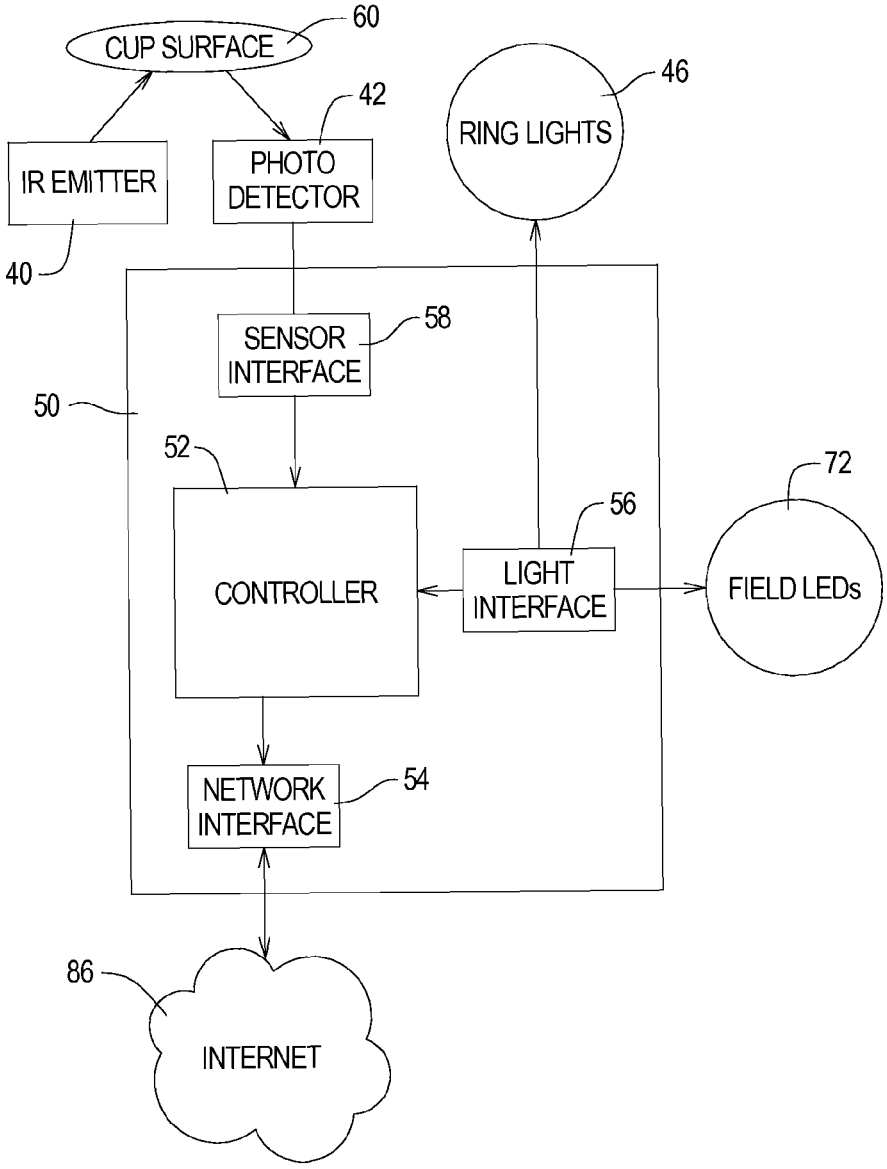
FIG. 12 is a schematic block diagram illustrating an example control system forming a part of the example game table system of FIG. 1.

A control system 50 is used to activate the cup lights 44 in response to the sense signal. The control system 50 may comprise analog circuits that generate control signals for a particular cup area 36 in response to the generation of a sense signal associated with that cup area 36. As illustrated in FIG. 12, the control system 50 may be embodied using a controller 52 and, optionally, a network interface 54, light interface 56, and/or a sensor interface 58. The example controller 52 is a general purpose computing device comprising memory and a microprocessor and is capable of interfacing with hardware and running software as will be described in further detail below.

If used, the example network interface 54 facilitates communication between the example controller 52 and a remote processing or computing device as will be described in further detail below. The network interface 54 may be omitted for a standalone game table system or, possibly, the function of the network interface 54 may be integrated into the controller 52.

If used, the light interface 56 and sensor interface 58 are configured to generate control signals for energizing the emitters 40 and cup lights 44 based on sense signals generated by the sensors 42. The functions of the light interface 56 and sensor interface 58 may be integrated into the controller 52 if the controller hardware is capable of receiving sense signals from the number of sensors 42 employed and generating control signals for the number of cup lights 44 employed.

Alternatively, the control system 50 may be configured to operate the cup lights 44 to indicate at which cup areas 36 the cups 24 are to be placed. In this case, the sensors 42 will confirm the presence of the cups 24 at the desired cup areas 36. The control system 50 may thus be configured to instruct users which one of the cup groupings 28 are appropriate for a given game scenario and confirm that the cups 24 are arranged in the appropriate cup grouping 28 for that given game scenario. In any scenario, the colors and/or pattern of energized cup lights 44 in the cup light arrays 46 may be changed to communicate information to the user and/or for purely aesthetic reasons.

Figure 4:
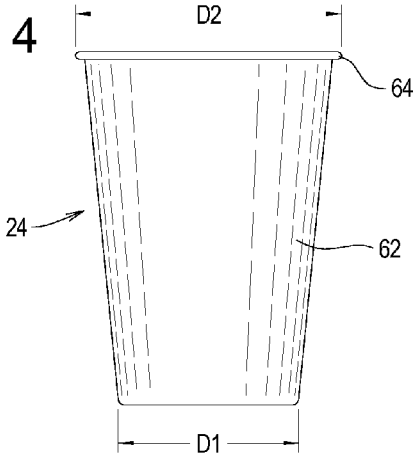
FIG. 4 is a side elevation view of a cup that may be used with the example game table of FIG. 1.

The construction and use of the example game table system 20 will now be described in further detail. The example cups 24 used with the game table system 20 all define substantially the same form factor. In particular, FIG. 4 of the drawing illustrates that the example cups 24 are or may be conventional drinking containers defining a bottom wall 60 and a side wall 62. The side wall 62 terminates at a cup edge 64. With the example cups 24, a diameter defined by the bottom wall 60 is associated with a value D1, and a diameter defined by the cup edge 64 is associated with a value D2. Further, the side wall 62 is in the shape of an inverted cone during normal use of the cup 24 such that the value D1 is less than the value D2.

Figure 5:
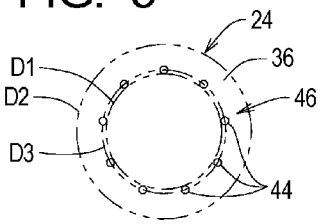
FIG. 5 is top plan view illustrating an example relationship between the example cup of FIG. 4 and a cup area of the example set-up area of FIG. 3.
Figure 6:
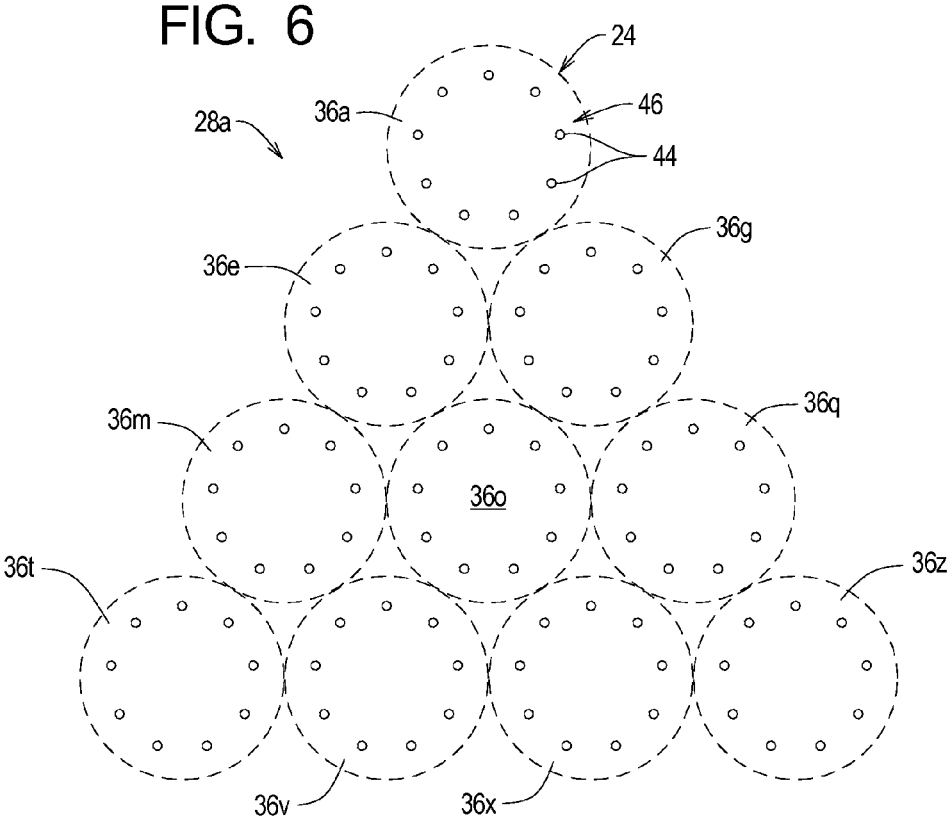
FIGS. 6-10 are top plan views of the example set-up area of FIG. 3 illustrating different cup groupings that are supported by the example game table system of FIG. 1.
Figure 7:
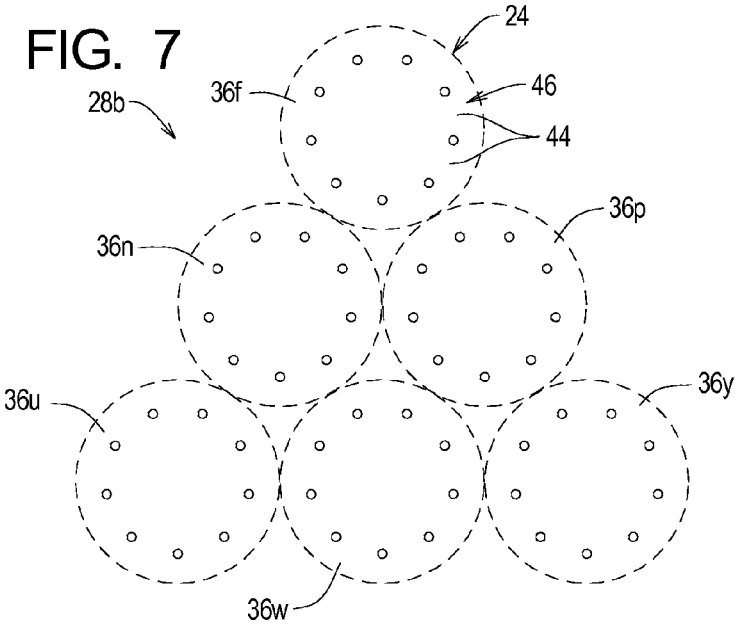
Figure 8:
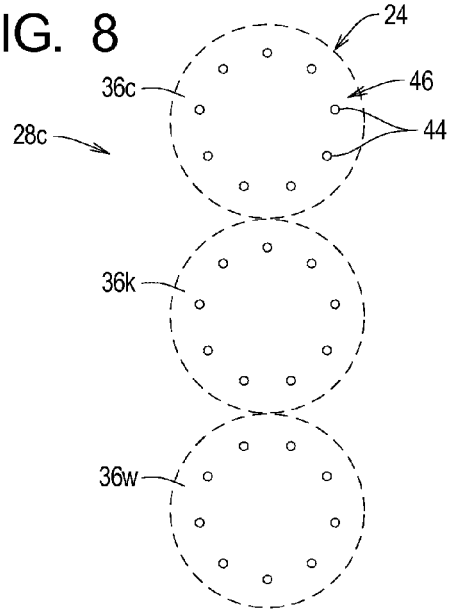
Figure 9:
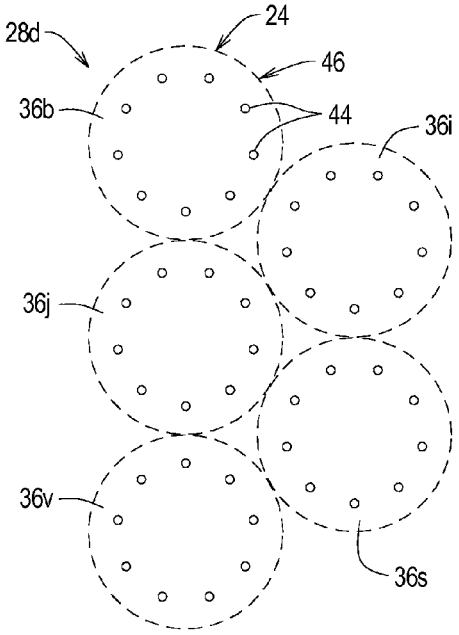
Figure 10:
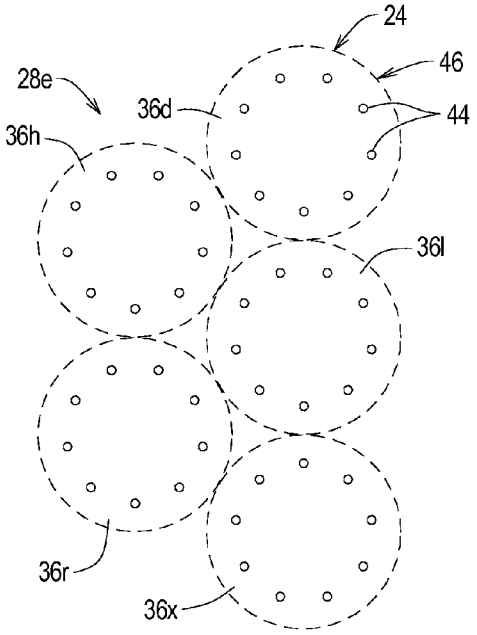

In the example game table system 20, a diameter defined by the cup array 46 is associated with the value D1, while a diameter defined by the cup areas 36 is associated with the value D2. With the example game table system 20, the cup areas 36 are just large enough to contain a selected one of the cups 24 on the game surface 22, when the bottom surface 60 of that selected cup 24 is centered within one of cup areas 36. Further, as perhaps best shown in FIG. 2 the cup areas 36 are arranged such that the cup edges 64 just touch when the cups 24 are centered within cup areas 36 in one of the cup groupings 28. FIG. 5 also illustrates a diameter D3 defined by the example cup light arrays 46 is slightly larger than the value D1 associated with the cup bottom surfaces 60 such that the cup lights 44 are visible when the cups 24 are centered within the cup areas 36.

Turning again to FIG. 1, it can be seen that the example game table system 20 further comprises a plurality of field lights 70 arranged in a field light array 72. The example game table system 20 is typically played in a low ambient light environment, and the field lights 70 may be turned on and off to enhance the playing conditions. In this context, the example field lights 70 may be primarily decorative but may also be configured to communicate information to the players such as the direction of play, notification that the cups 24 are arranged in one of the proper cup groupings 28 and the game can commence, and the like. If used, the light interface 56 may be configured to control the field lights 70. Optionally, a separate field light interface may be provided, or the controller 52 may be configured to control each of the field lights 70 directly.

Figure 13:
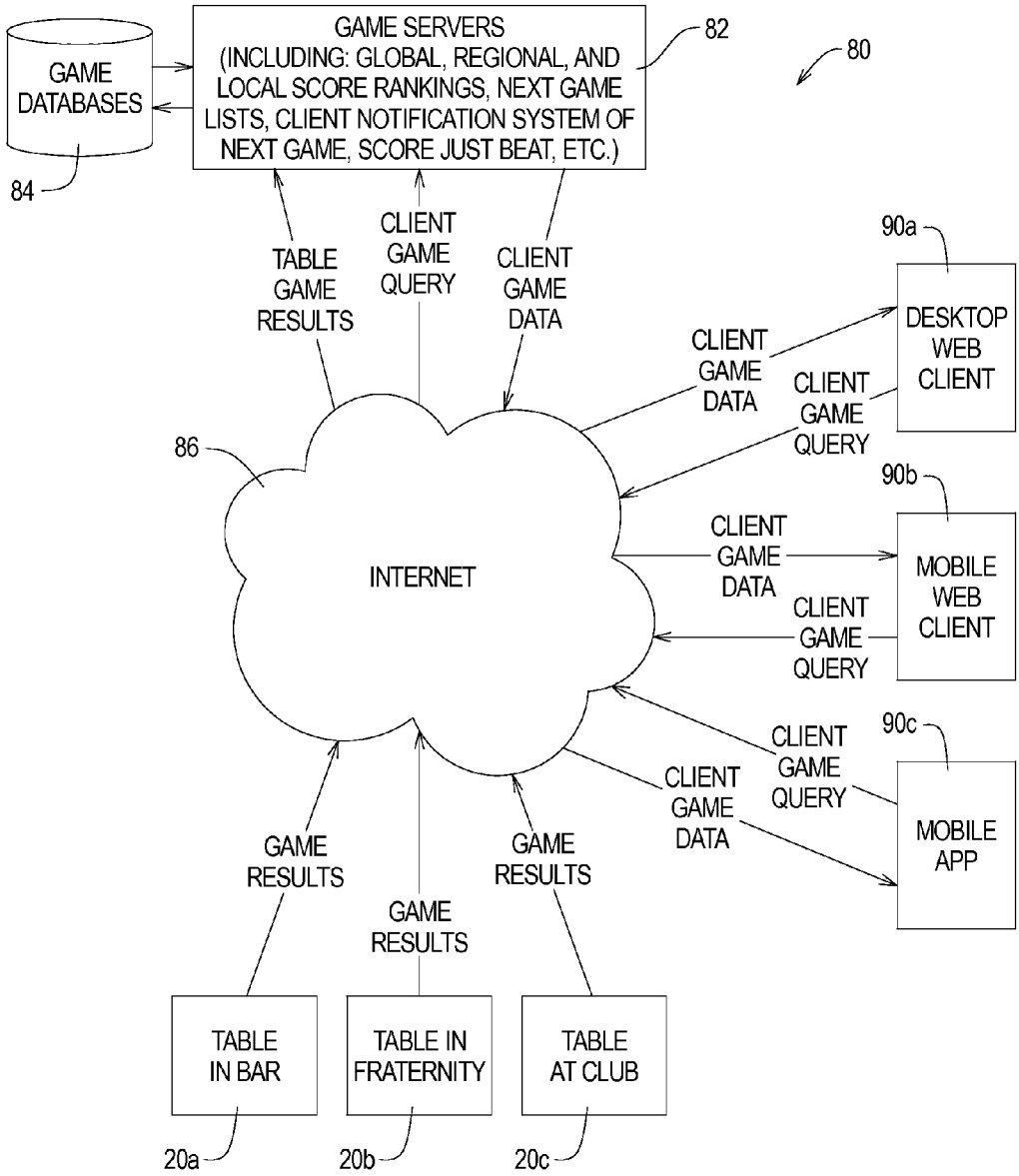
FIG. 13 is a schematic block diagram illustrating an example game network system incorporating one or more game table systems such as the example game table system of FIG. 1.

As shown in FIG. 13 of the drawing, a game table system of the present invention may be played as part of a larger game system 80 comprising one or more game servers 82, a game database 84, and a communications network 86 such as the Internet. The one or more game servers 82 are in communication with the game database 84 and the communications network 86. The example game system 80 further comprises one or more clients 90 identified as a desktop web client 90*a*, a mobile web client 90*b*, and a mobile app (application) 90*c* as shown in FIG. 13. These clients 90*a*, 90*b*, and 90*c* are also in communication with the communications network 86 and thus the one or more game servers 82.

In this example gaming system 80, a plurality of the game table systems 20*a*, 20*b*, and 20*c* are provided. In this context, each of the game table systems 20*a*, 20*b*, and 20*c* will be provided with a network interface such as the network interface 54 described above. The network interfaces allow the game table systems 20*a*, 20*b*, and 20*c* to communicate with the communications network 86 and, through this network 86, to each other and to the one or more game servers 82 and any clients 90 such as the clients 90*a*, 90*b*, and 90*c*.

The example game system 80 allows multi-player games, remote games, and/or tournaments. The clients 90 allow players and other interested parties to monitor games and/or tournaments from anywhere with access to the communications network 86. In particular, the game table systems 20*a*, 20*b*, and 20*c* send game results and status data to the game servers 82 through the communications network 86. The game results may be stored, sorted, and otherwise processed by the game servers 82 and game databases 84. At that point, the clients 90*a*, 90*b*, and 90*c* can query the database 84 through the communications network 86 and game servers 82 such that game data is returned to the clients 90.

Figure 14:
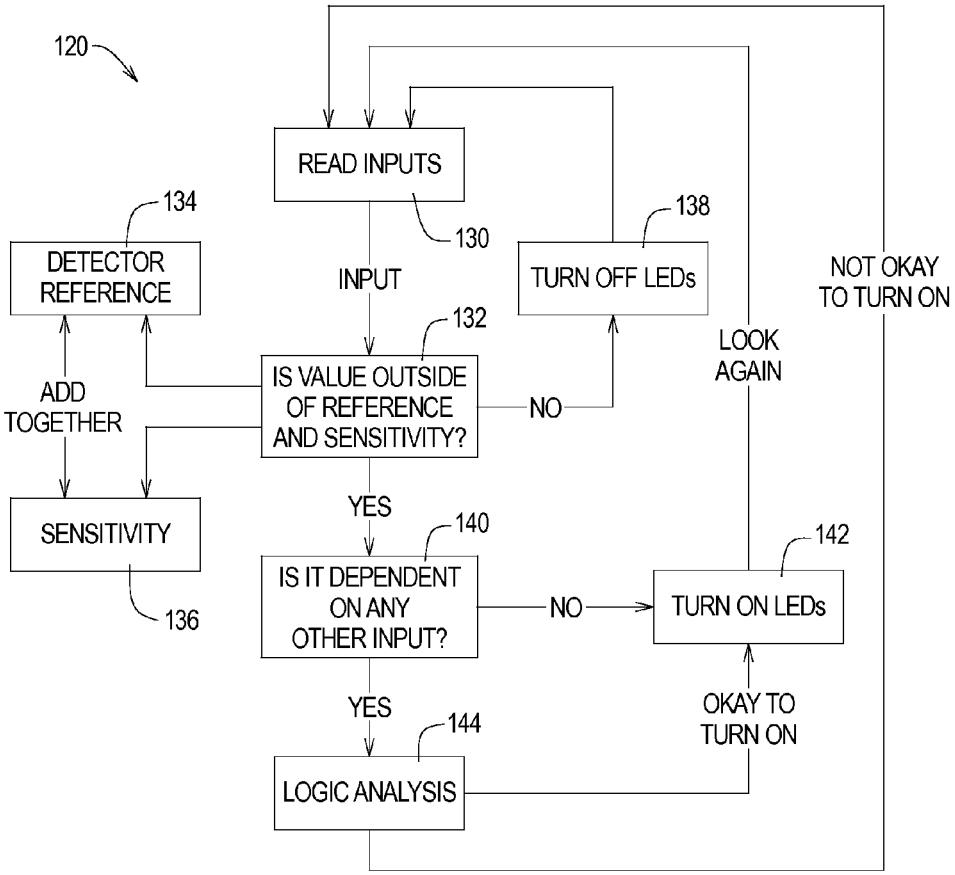
FIG. 14 is a flow chart depicting one example sensing/illumination process that may be implemented by the example control system of FIG. 12.

Referring now to FIG. 14 of the drawing, depicted therein is a logic flow diagram 120 illustrating one example method that may be implemented by the control system 50. More specifically, the example logic flow depicted in the diagram 120 may be embodied as software running on the controller 52.

At a step 130, inputs to the controller 52 are read to generate sensor data representing the status of the sensor signals generated by the various sensors 42. The sensor data is processed at step 132 to determine whether a value thereof is within a predetermined reference and sensitivity range. This determination is made for each of the sensors 42 by adding detector reference and sensitivity values as shown at steps 134 and 136. If the values are not within the ranges, the cup lights 44 in the cup light array 46 associated with the given sensor 42 are turned OFF at step 138.

If the values are within the predetermined range, step 140 determines whether any other input is required to turn the cup lights 44 in the cup array 46 associated with the given sensor 42. If not, the cup lights 44 in the cup array 46 associated with the given sensor 42 are turned ON at step 142 and the logic flow returns to step 130.

If other another input is required to turn the cup lights 44 in the cup array associated with the given sensor 42 ON, additional logic analysis is performed at step 144 to determine whether such additional inputs are present. If these additional inputs are present, the cup lights 44 in the cup array 46 associated with the given sensor 42 are turned ON at step 142, and the logic flow returns to step 130. If any required additional inputs are determined not to be present at step 144, the cup lights 44 in the cup array 46 associated with the given sensor 42 remain OFF, and the process returns to step 130.

Referring now for a moment back to FIG. 1, the structure of the example game table system 20 will be described in further detail. The example game table system comprises a table structure 220. In top plan view as shown in FIG. 1, the example table structure 220 is rectangular and defines a first end edge 222, a second end edge 224, a first side edge 226, and a second side edge 228.

Figure 2:
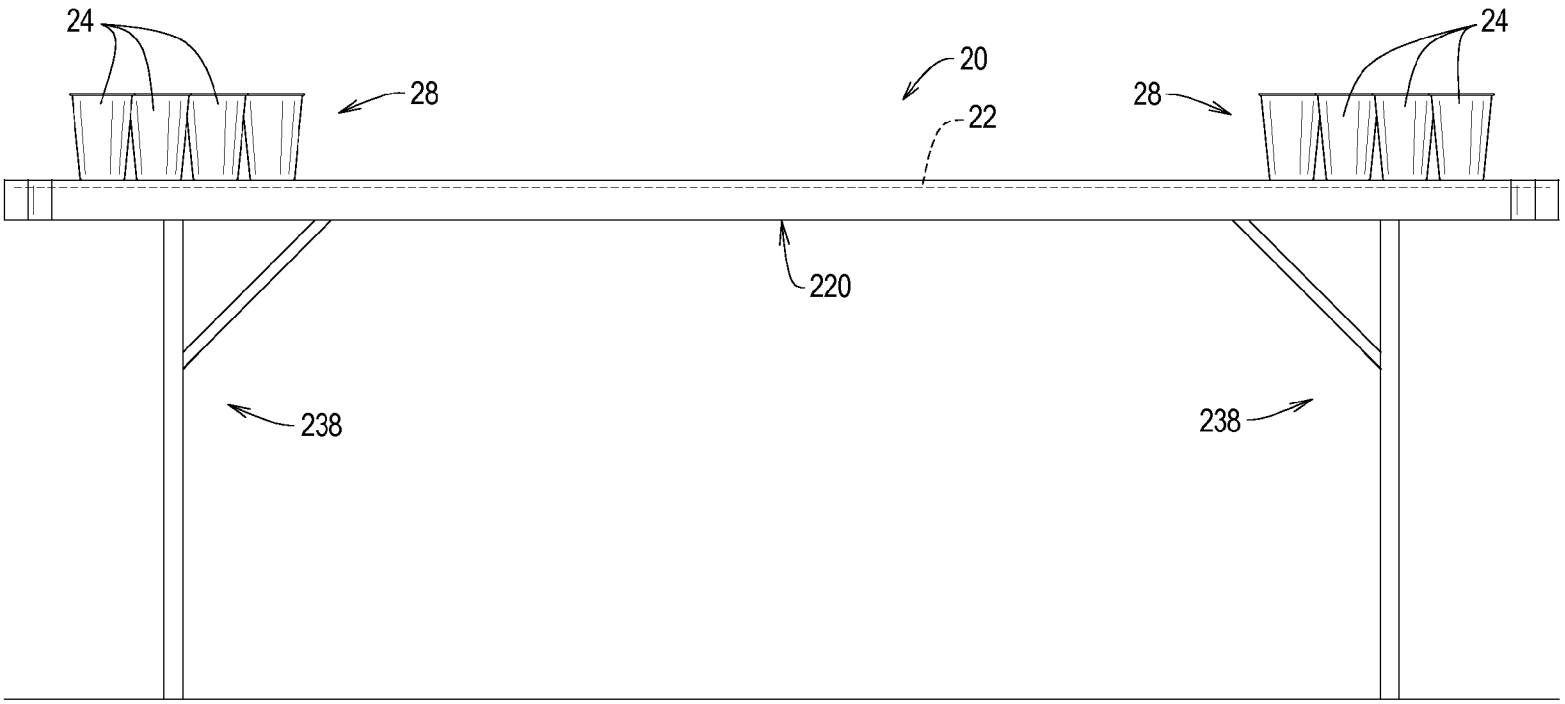
FIG. 2 is side elevation view of the example game table depicted in FIG. 1.
Figure 15:
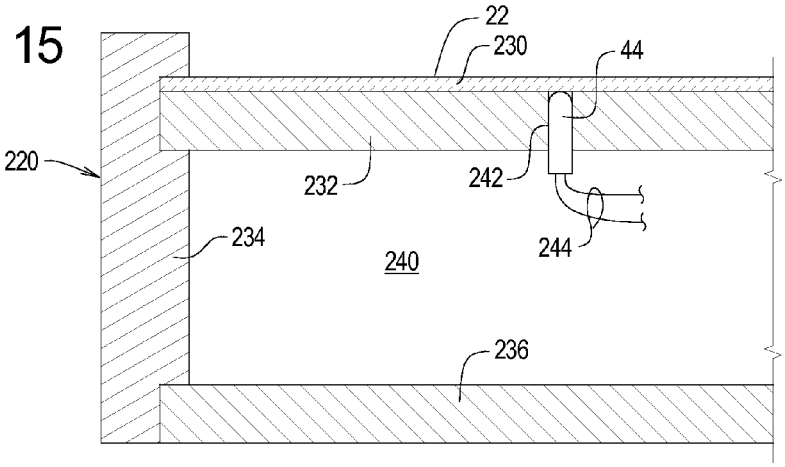
FIG. 15 is an end elevation section view depicting a portion of the example game table system of FIG. 1.
Figure 17:
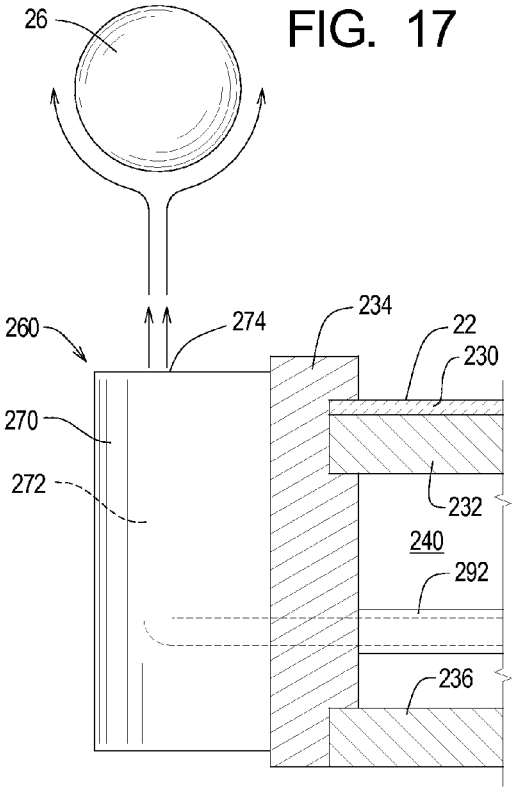
FIG. 17 is an end elevation, partial section view depicting the example ball support system of FIG. 16.

As perhaps best shown in FIGS. 15 and 17, the example table structure 220 comprises a surface member 230, a support member 232, one or more edge members 234, a bottom member 236, and a plurality of leg assemblies 238 (FIG. 2). The surface member 230 defines the game surface 22.

The example support member 232 is made of a material and in dimensions capable of structurally spanning the area between the edges 222-228 during normal use of the game table system 20, even when holes are formed in the support member 232 as will be described in further detail below. The example support member 232 supports the surface member 230 to allow the surface member 230 to be made of a material and in dimensions that may not otherwise be capable of spanning the area between the edges 222-228 during normal use of the game table system 20.

The surface member 230 is made of a relatively rigid material capable of allowing the balls 26 to be bounced thereon during normal play of beer pong. The surface member 230 is also typically made of an easily cleanable, fluid impermeable material such as plastic or glass. The surface member may also be made of a clear material that allows the cup lights 44 and field lights 70 to be visible from above the game surface 22 as will be described in further detail below. The example surface member 230 is made of clear plastic.

The support member 232 will be made of a relatively strong, rigid material such as plastic, glass, stone or marble, wood, plywood, particle board, fiberboard, metal, composites, and/or the like capable of meeting the structural requirements described above. The example support member 232 is made of high-density fiberboard. An upper surface of the support member 232 that may be visible through the surface member 230 may be coated, covered with a layer of aesthetic material, and/or otherwise decorated with designs, textures, graphics, and printed messages to enhance the experience of the users of the game table system 20.

The example edge members 234 are secured to the surface member 230 and support member 232 such that the edge members 234 extend around the game surface 22 and define the edges 222-228. Optionally, the edge members 234 may be integrally formed with one or both of the surface member 230 and support member 232. The leg assemblies 238 are operatively connected to the edge members 234 and/or the bottom member 236 such that the game surface 22 is rigidly support at a height desirable for the play of beer pong.

The example bottom member 236 may be configured and connected to the edge members 234 and/or to the leg assemblies 238 to provide rigidity to the table structure 220 and/or to define a table cavity 240 below the support member 232. If the bottom member 236 is formed of a solid sheet of material, inadvertent access to the table cavity 240 may be substantially prevented.

FIG. 15 further illustrates that a table bore 242 is formed for each of the emitters 40, sensors 42, cup lights 44, and field lights 70 (only one table bore 242 is shown in FIG. 15 for purposes of clarity). Each table bore 242 extends through support member 232.

In the example shown in FIG. 15, one of the cup lights 44 is illustrated within the depicted table bore 242. The depicted cup light 44 is visible through the surface member 230, and a wire pair 244 capable of carrying current sufficient to energize the depicted cup light 44 may be extend through the table cavity 240 to the cup light 44. The other end of the wire pair 244 will be connected to a light interface or controller of the example control system 50 described above or may be connected to another type of control system such as an analog circuit operatively and directly connected to an associated one of the sensors 42. The wire pairs 244 thus carry control signals capable of energizing the depicted cup light 44 as appropriate. The wire pairs 244 may be configured to carry other types of signals such as emitter signals, sense signals, or the like depending on the device (emitter, sensor, cup light, field light) to which the wire pairs 244 are connected.

Referring for a moment back to FIG. 1, it can be seen that the example game table system 20 defines first, second, third, and fourth corner stations 250, 252, 254, and 256. Located at these corner stations 250-256 are first, second, third, and fourth ball support systems 260, 262, 264, and 266, respectively. The example ball support systems 260-266 are identical, and only first ball support system 260 will be described herein in detail.

Figure 16:
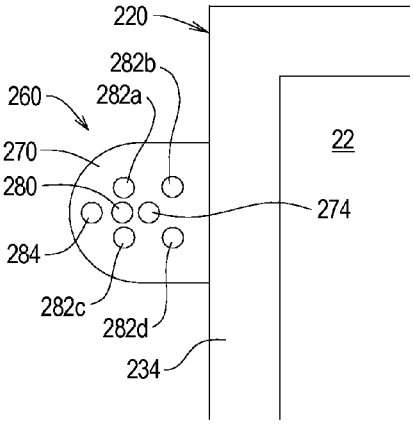
FIG. 16 is a top plan view depicting an example ball support system that may be used by the example game table system of FIG. 1.

In particular, FIGS. 16 and 17 illustrate that the ball support system 260 comprises a support block 270 defining an air channel 272 that terminates in an air opening 274. The air channel 272 is operatively connected to a source of pressurized air 276 as will be described in further detail below with respect to FIG. 18. Pressurized air flowing through the air channel 272 is directed upwardly through the air opening 274 and supports one of the balls 26 using the Bernoulli effect such that the supported ball 26 appears to levitate above the support block 270.

FIG. 16 further indicates that one or more emitters 282, one or more sensors 280, and one or more ball lights 284 may be mounted on the support block 270 adjacent to the air opening 274. The example emitter(s) 282 and sensor(s) 280 may be arranged to detect the presence of one of the balls 26 being held over the ball support system 260. When a ball 26 is sensed, the flow of pressurized air is begun, and a solenoid valve or similar pressurized air control valve is opened to allow the flow of pressurized air through the air channel 272. The pressurized air continues until the sensor 280 no longer detects a ball 26 present. The light(s) 284 may be energized when the sensor(s) 280 detects that one of the balls 26 is being supported by the ball support system 260. The presence of the balls 26 as detected by the sensor(s) 280 may also be transmitted to the control system 50 and used to update the status of the game being played. Alternatively, the emitter(s) 282 and/or sensor(s) 280 may be omitted, in which cases the lights 284 may be configured continuously to illuminate the area were one of the balls 26 would be supported by the ball support system 260.

Figure 18:
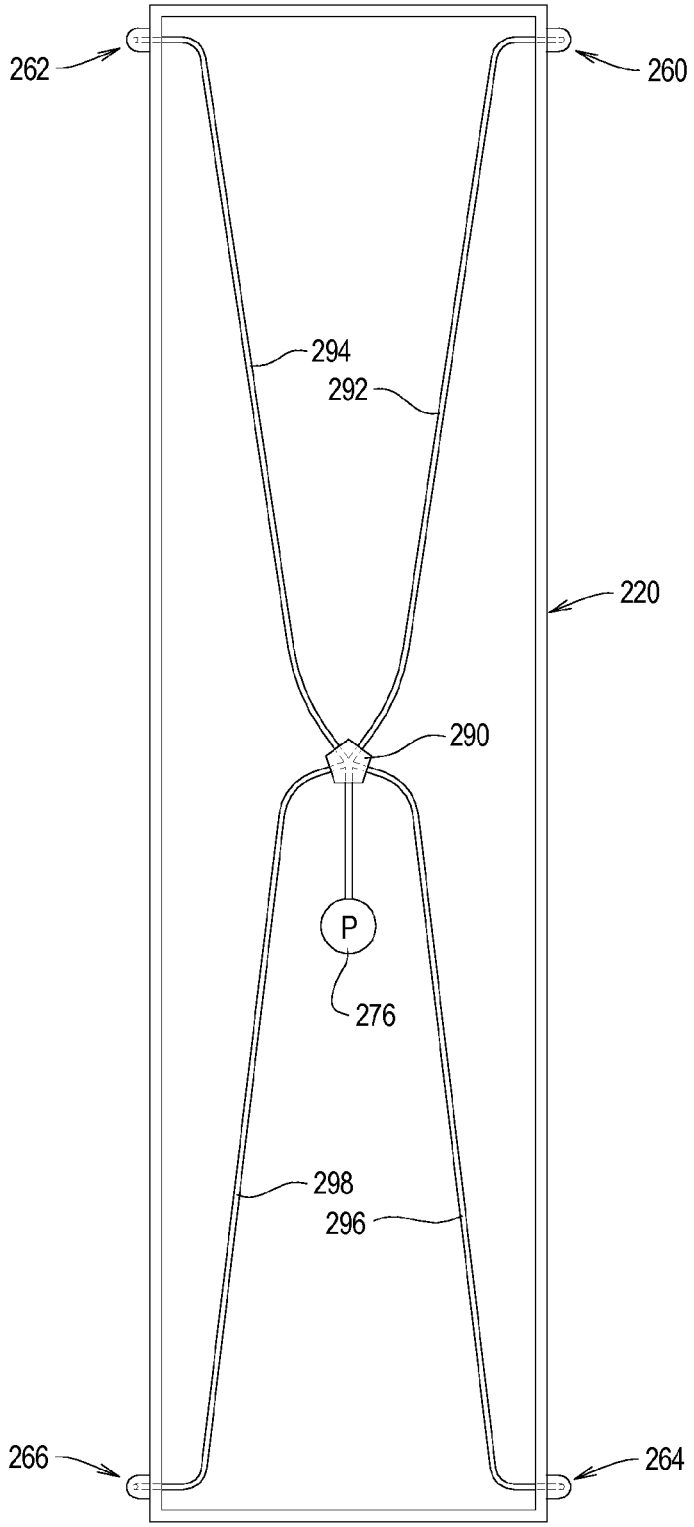
FIG. 18 is a bottom plan view of manifold system that may be used to supply air to the example air support system of FIG. 16.

FIG. 18 illustrates that a single source of pressurized air 276 may be connected to a manifold 290 that is in turn connected to first, second, third, and fourth conduits 292, 294, 296, and 298 that are configured to supply air to the first, second, third, and fourth ball support systems 260, 262, 264, and 266, respectively. Additional valves may be provided to allow control of air flow along the conduits 292, 294, 296, and 298.

What is claimed is:

1. A game table system adapted to be used with a plurality of cups and at least one ball, comprising:

a table structure defining a game surface;

a plurality of cup areas defined on the game surface, where at least first and second cup areas overlap in part;

a sensor associated with each of the cup areas; and at least one cup light associated with each of the cup areas; wherein the at least cup light is energized to indicate locations of the cup areas;

each sensor is configured to detect when a cup is supported by the game surface on the cup area associated with that sensor; and the sensors associated with first and second overlapping cup areas are arranged to distinguish between a cup placed on the first overlapping area and a cup placed on the second overlapping cup area.

2. A game table system as recited in claim 1, in which the at least one cup light is energized in response to detection of a cup by at least one of the sensors.

3. A game table system as recited in claim 1, in which the cup light associated with a given cup area is energized when the sensor associated with that given cup area detects the presence of a cup on that given cup area.

4. A game table system as recited in claim 1, in which each sensor is uniquely associated with each of the cup areas.

5. A game table system as recited in claim 1, further comprising a plurality of emitters.

6. A game table system as recited in claim 5, in which each emitter is associated with one of the sensors.

7. A game table system as recited in claim 1, in which:

a plurality of cup lights are arranged in at least one cup array; and each cup array is associated with one of the cup areas.

8. A game table system as recited in claim 1, further comprising a control system operatively connected to control the cup lights based on the sensors.

9. A game table system as recited in claim 1, further comprising at least one ball support system that supports the at least one ball using a stream of pressurized air.

10. A method of playing a game using a plurality of cups and at least one ball, comprising:

defining a game surface;

defining a plurality of cup areas on the game surface, where at least first and second cup areas overlap in part;

associating a sensor with each of the cup areas; and associating at least one cup light with each of the cup areas;

energizing the at least cup light to indicate locations of the cup areas;

configuring each sensor to detect when a cup is supported by the game surface on the cup area associated with that sensor; and arranging the sensors associated with first and second overlapping cup areas to distinguish between a cup placed on the first overlapping cup area and a cup placed on the second overlapping cup area.

11. A method as recited in claim 10, further comprising the step of energizing the at least one cup light in response to detection of a cup by at least one of the sensors.

12. A method as recited in claim 10, further comprising the step of energizing the cup light associated with a given cup area when the sensor associated with that given cup area detects the presence of a cup on that given cup area.

13. A method as recited in claim 10, further comprising the step of providing a plurality of emitters, where each emitter is associated with one of the sensors.

14. A method as recited in claim 10, further comprising the step of providing at least one ball support system configured to support the at least one ball using a stream of pressurized air.

15. A game table system adapted to be used with a plurality of cups and at least one ball, comprising:

a table structure defining a game surface where the game surface defines first and second set-up areas and a field area;

a plurality of cup areas defined within each of the set-up areas defined by the game surface, where at least first and second cup areas overlap in part;

a plurality of sensors supported by the table structure, where each of the sensors is uniquely associated with one of the cup areas, and the sensors associated with first and second overlapping cup areas are arranged to distinguish between a cup placed on the first overlapping cup area and a cup placed on the second overlapping cup area;

a plurality of cup light arrays, where each cup light array comprises a plurality of cup lights, and each cup light array is uniquely associated with each of the cup areas; and a control system operatively connected to the sensors and the cup lights, where each sensor is configured to detect when a cup is supported by the game surface on the cup area associated with that sensor, and the control system energizes the cup lights such that the cup light arrays indicate a location of at least one of the cup areas.

16. A game table system as recited in claim 15, further comprising a plurality of emitters, where each emitter is associated with one of the sensors.

17. A game table system as recited in claim 15, further comprising at least one ball support system that supports the at least one ball using a stream of pressurized air.

* * * * *